United States Patent [19]

Numabe

[11] 4,287,585

[45] Sep. 1, 1981

[54] CHRONOGRAPH WRISTWATCH

[75] Inventor: Hitomi Numabe, Suwa, Japan

[73] Assignee: Kabushiki Kaisha Suwa Seikosha, Tokyo, Japan

[21] Appl. No.: 744,056

[22] Filed: Nov. 22, 1976

Related U.S. Application Data

[63] Continuation of Ser. No. 404,452, Oct. 9, 1973, Pat. No. 3,992,871.

[30] Foreign Application Priority Data

Oct. 9, 1972 [JP] Japan ..... 49/101231

[51] Int. Cl.[3] ..... G04C 19/00; G04F 8/00

[52] U.S. Cl. ..... 368/82; 368/107

[58] Field of Search ..... 58/23 R, 39.5, 50 R, 58/74, 85.5, 127 R; 368/82, 107, 111, 113, 239

[56] References Cited

U.S. PATENT DOCUMENTS

| | | | |
|---|---|---|---|
| 3,646,751 | 3/1972 | Purland et al. | 58/152 |
| 3,757,509 | 9/1973 | Fujita | 58/39.5 |
| 3,795,099 | 3/1974 | Tsurushi | 58/23 R |
| 3,803,827 | 4/1974 | Roberts | 58/4 A |
| 3,854,277 | 12/1974 | Samejima | 58/39.5 |
| 3,961,472 | 6/1976 | Riehl | 58/50 R |

*Primary Examiner*—Vit W. Miska

*Attorney, Agent, or Firm*—Blum, Kaplan, Friedman, Silberman & Beran

[57] ABSTRACT

An electronic timepiece having a single digital display and being suitable to operate as a standard timekeeping wristwatch or in the alternative as a chronograph. Separate divider circuits are provided for performing the timekeeping and chronograph functions. A single set of switches is provided for controlling the operation of either divider circuit, a single selector circuit selecting which function is to be displayed and which divider is to be controlled by the switches. Indication means are provided for indicating which function is being displayed.

1 Claim, 3 Drawing Figures

CHRONOGRAPH WRISTWATCH

This is a continuation of application Ser. No. 404,452, filed on Oct. 9, 1973, now U.S. Pat. No. 3,992,871.

BACKGROUND OF THE INVENTION

This invention relates generally to an electronic timepiece adapted to provide standard timekeeping and/or chronographic display of time and especially to an electronic wristwatch having a chronographic display including indicating means for indicating the chronographic function selected.

While chronographic wristwatches having stopwatch and measuring capabilities which also include timekeeping displays have taken on various forms, such wristwatches have been found to have various defects during normal operation. Particularly, when such chronographic wristwatches are mechanical and are used as a stopwatch, the hour and minute hands for displaying time are usually indistinguishable from those used for the stopwatch function. Moreover, because it is necessary to use the second hand as a stopwatch hand the accurate measuring of seconds during normal timekeeping cannot be maintained. Also, it is extremely difficult to measure exact time periods to units less than a second because of the small displacement of the second hand.

Many of these problems can be overcome by wristwatches having a single digital display and separate chronographic divider and timekeeping divider circuits, the chronographic divider circuits providing for chronographic accuracy to tenths and hundredths of seconds which is unobtainable in mechanical watches. Moreover, because separate divider circuits are utilized the information necessary for an accurate second display is in no way affected by the use of the wristwatch as a chronograph. However, such wristwatches which incorporate a timekeeping and chronographic capability suffer from certain drawbacks in circuit complexity and chronographic operation. Specifically, during chronographic operation it is impossible to distinguish between when the display has been stopped because of a start-stop operation and when the display has been stopped during a lap operation wherein the lap time is displayed but the chronographic divider circuit continues to count.

SUMMARY OF THE INVENTION

Generally speaking, in accordance with the invention, an electronic wristwatch is provided with a single digital display and electronic circuitry for providing conventional timekeeping and chronographic function for selective display. A high frequency time standard signal is provided to both a chronographic divider means which produces low frequency chronographic signals representative of elapsed time and to a timekeeping divider means which produces low frequency timekeeping signals representative of present time. A selector circuit means is coupled to both divider means to receive the output thereof. Digital display means is coupled to the output signal of either of the chronographic divider means or timekeeping divider means as selected by the selector circuit means. A single set of switches is provided for controlling the operation of either divider circuit. The selector circuit means further connects said single set of switches and both said timekeeping and chronograph divider means for selecting which divider circuit means is controlled by said switches. A switch is provided for operating said selector circuit means.

Indication means are provided in said digital display means for indicating the nature of the chronographic operation when such chronographic function is selected.

Accordingly, it is an object of this invention to provide an improved digital display chronographic wristwatch.

Another object of the invention is to provide an improved digital display electronic chronographic wristwatch wherein the same switches are used to correct the time displayed and to control the chronographic use thereof. A further object of the invention is to provide an improved chronographic wristwatch wherein the second display of standard time is in no way affected by the use of the wristwatch as a chronograph.

Still another object of the invention is to provide an improved wristwatch wherein the chronographic display is accurate to and capable of displaying less than second units.

Still another object of the invention is to provide an improved chronographic wristwatch wherein means are provided for indicating the chronographic operation being performed thereby.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which.

DESCRIPTION OF THE PREFERRED EMBODIMENT

Figure 1:
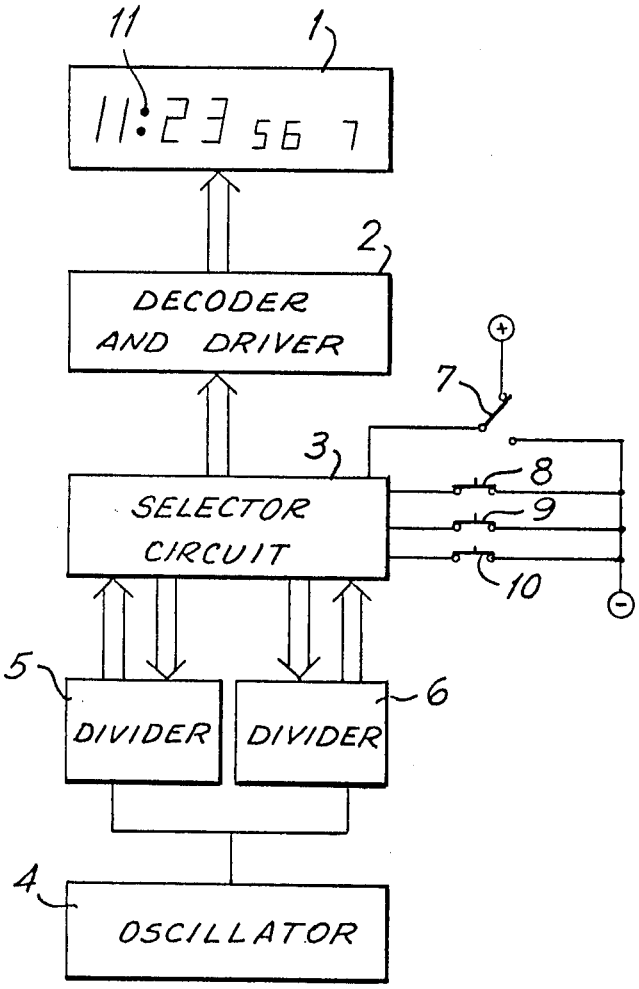
FIG. 1 is a block diagram of electronic wristwatch circuit adapted to display either standard timekeeping information or chronographic information constructed in accordance with a preferred embodiment of the instant invention.
Figure 2:
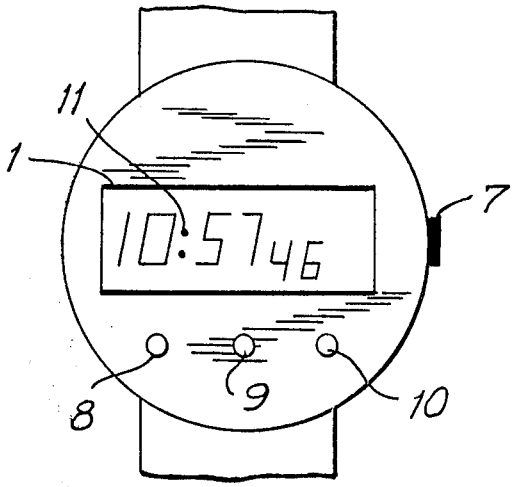
FIGS. 2 and 3 are perspective views of an electronic timepiece including the circuit of FIG. 1 respectively disposed in a standard time display and chronographic display mode.
Figure 3:
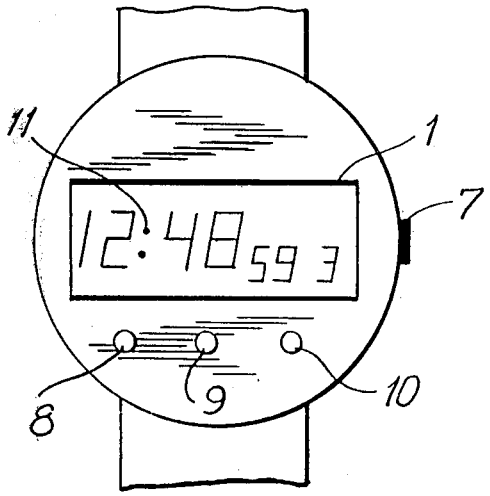

Referring now to FIGS. 1 through 3, an electronic timepiece having a conventional digital display such as a liquid crystal display, for displaying numerals representative of hours, minutes, seconds and tenths of seconds is depicted. An oscillator circuit 4 which includes a quartz crystal vibrator, is coupled to a timekeeping divider circuit 5 and a chronographic divider circuit 6 for applying high frequency time standard signals thereto. The timekeeping divider circuit 5 consists of a multi-stage divider chain capable of counting seconds, minutes and hours and producing, as an output, timekeeping signals representative of present time as reflected by the count in the respective divider stages. The chronographic divider circuit 5 likewise consists of a multi-stage divider chain, but this circuit is capable of counting tenths of seconds, seconds, minutes and hours. The output of the chronographic divider circuit is chronographic signals representative of the time being measured as reflected by the count of the respective divider stages. The output of timekeeping divider circuit 5 and chronographic divider circuit 6 are supplied to selector circuit 3. A digital display 1 is coupled to the selector circuit 3 by decoder and driver circuit 2 which operates a digital display in response to the low frequency signals applied thereto by the selector circuit 3. The selector circuit applies either the output of chronographic divider circuit 6 or the output of timekeeping divider circuit 5 to decoder and driver circuit 2 in response to the setting of changeover switch 7, to thereby display either elapsed or present time. The selector circuit 3 is further connected between control switches 8, 9 and 10 and both timekeeping divider circuit 5 and chronographic divider circuit 6 and is further connected to changeover switch 7 for operation thereby. The selector circuit 3 selectively connects switches 8, 9 and 10 to either of the divider circuits in response to the setting of changeover switch 7.

When changeover switch 7 sets the selector circuit 3 so that control switches 8, 9 and 10 are connected to timekeeping divider circuit 5, the switches serve as time correction switches, being respectively connected to the divider stages producing the second, minute and hour signals respectively for the separate correction of said divider stages to selectively correct the second, minute or hour time indication displayed by the display 1. The correction may be achieved by indexing the count of the associated divider stage by one upon each operation of control switches 8, 9 and 10. This setting of changeover switch 7 is depicted in FIG. 2, wherein time in hours, minutes and seconds is displayed by digital display 1 and if the incorrect time is displayed thereby, correction thereof is easily effected by control switches 8, 9 and 10.

On the other hand, when it is desired to utilize the timepiece as a chronograph, changeover switch 7 is placed in second position thus activating the selector circuit 3 to supply the low frequency signal output of chronographic divider circuit 6 to display 1 and to further couple control switches 8, 9 and 10 through the selector circuit 3 to said chronographic divider means. As depicted in FIG. 3, control switches 8, 9 and 10 respectively perform the reset, start-stop and lap control functions when changeover switch 7 is disposed in the chronograph position.

In the chronograph mode, control switch 8 is connected to the divider stages of chronographic divider circuit 6 to reset the divider stages to zero; control switch 9 is connected to said chronograph divider stages to selectively start and stop the operation of said chronographic divider circuit to perform the chronographic function; and control switch 10 is connectd to said divider stages to apply the instantaneous output of the chronographic divider circuit stages to display 1 and to hold and display the resultant elapsed time while the chronographic divider circuit continues the count (the elapsed time of a lap).

Thus, the problems which inure to a mechanical chronographic wristwatch are overcome because the digital display during timekeeping is completely independent of the digital display during chronographic operation and the problems of misreading information are thereby eliminated. Also, the switching over the timepiece to the chronographic operation in no way affects the timekeeping divider circuit so that when the timepiece changes back to normal timekeeping operation, the seconds display remains accurate, a feature which as pointed out above, is difficult to attain in mechanical watches, wherein the second hand is used for the stopwatch function.

As is illustrated in FIGS. 2 and 3, the elapsed time period displayed by the wristwatch when used as a chronograph displays the elapsed time in units of hours, minutes, seconds, and tenths of seconds while the display when the wristwatch is utilized as a timepiece displays the time in units of hours, minutes and seconds, the tenths of second display being eliminated. Thus, discrimination between the timekeeping display and the elapsed time display is easily performed.

The other problem of being able to discriminate between a start-stop operation and a lap operation in such a digital display is overcome by including a display portion such as a liquid crystal display which lights up to indicate when the stopwatch mechanism is being used for a particular operation, such as measuring lap times. However, such a display means for indicating that the chronographic divider circuit is still counting time would require extra space within the wristwatch, a feature which is less than completely satisfactory in electronic wristwatches wherein such space requirement is maintained at a minimum. The aforementioned space requirement problem is overcome by including dots 11 between the hours and minutes display in digital display 1. The dots are selectively coupled to chronographic divider means 6 through selector circuit 3 and decoder and driver circuit 2 to allow the dots 11 to be lit by the power generated thereby. Specifically, the dots are coupled to an output of one of the intermediate stages of the chronographic divider 6 to allow the dots 11 to blink when said chronographic divider means 6 is counting and when said chronograph divider is set in the lap time mode by control switch 10. Thus, when the chronographic wristwatch is used for timing laps, the dots 11 will continue to blink while the counter is counting even though the display will be held in the lap time display. Thus, the operator can clearly discriminate whether the wristwatch is in a start-stop operation or in a lap time operation. Furthermore, the dots 11 can be maintained in an always lit condition when the timekeeping display is utilized to further aid the operator in discriminating as to whether the timepiece is in a chronographic display mode or a timekeeping display mode.

As is appreciated, the dots provide a display means for indicating the nature of the chronographic operation of the wristwatch while still occupying a minimal portion of the watch face. Thus, a digital display chronographic wristwatch which is easy to use and provides a practical yet extremely accurate time measuring function is herein provided. Said selector circuit 3 may consist of suitable solid state switching circuitry formed, for example, of MOS transistors.

It will thus be seen the objects set forth above, among those made apparent from the preceding description, are efficiently attained and, since certain changes may be made in the above construction without departing from the spirit and scope of the invention, it is intended that all matter contained in the above description are shown in the accompanying drawing shall be interpreted as illustrative and not in a limiting sense.

It is also to be understood that the following claims are intended to cover all of the generic and specific features of the invention herein described, and all statements of the scope of the invention in which, as a matter of language, might be said to fall therebetween.

What is claimed is:

1. An electronic timepiece comprising oscillator means for generating relatively high frequency time standard signals; chronographic divider means coupled to said oscillator means and adapted to produce low frequency chronographic signals representative of elapsed time in response to said time standard signals; timekeeping divider means coupled to said oscillator means and adapted to produce low frequency timekeeping signals representative of present time in response to said time standard signals; selector circuit means coupled to said chronographic divider means for receiving said chronographic signals and to said timekeeping divider means for receiving said timekeeping signals, said selector circuit means having an output to which one of said chronographic signals and timekeeping signals are selectively applied; and digital display means coupled to the output of said selector circuit means, said digital display means including display elements for displaying one of an elapsed time and lap time in response to said chronographic signal being supplied by said selector circuit means and present time in response to said timekeeping signals supplied by said selector circuit means, said display means including further visual indication means, said further visual indication means being selectively disposed to a preselected visual mode representative of the selective coupling of said chronographic divider means output to said digital display means to display lap time and the continued counting of elapsed time of said chronographic divider means, said further visual indication means including at least one dot in the region of, but not forming a part of, the digital display of time, said dot being flickered when said display means is selectively coupled to the chronographic divider means.

* * * * *